US005796026A

United States Patent [19]

Tohgi

[11] Patent Number: 5,796,026

[45] Date of Patent: Aug. 18, 1998

[54] ELECTRONIC MUSICAL APPARATUS CAPABLE OF AUTOMATICALLY ANALYZING PERFORMANCE INFORMATION OF A MUSICAL TUNE

[75] Inventor: Yutaka Tohgi, Hamamatsu, Japan

[73] Assignee: Yamaha Corporation, Japan

[21] Appl. No.: 798,611

[22] Filed: Feb. 11, 1997

Related U.S. Application Data

[63] Continuation of Ser. No. 319,616, Oct. 7, 1994, abandoned.

[30] Foreign Application Priority Data

Oct. 8, 1993 [JP] Japan ..... 5-253410
Oct. 8, 1993 [JP] Japan ..... 5-253411
Oct. 8, 1993 [JP] Japan ..... 5-253412

[51] Int. Cl.[6] ..... G10H 1/26; G10H 1/28; G10H 1/38

[52] U.S. Cl. ..... 84/609; 84/613; 84/638; 84/DIG. 22

[58] Field of Search ..... 84/609–614, 634–638, 84/645–652, 666–669, 453, DIG. 22

[56] References Cited

U.S. PATENT DOCUMENTS

| | | | |
|---|---|---|---|
| 4,191,082 | 3/1980 | Koike | 84/622 |
| 4,519,286 | 5/1985 | Hall et al. | 84/DIG. 22 |
| 4,771,671 | 9/1988 | Hoff, Jr. | 84/453 X |
| 4,829,872 | 5/1989 | Topic et al. | 84/453 |
| 4,887,504 | 12/1989 | Okamoto et al. | 84/715 |
| 4,941,387 | 7/1990 | Williams et al. | 84/DIG. 22 |
| 5,221,802 | 6/1993 | Konishi et al. | 84/637 |
| 5,241,128 | 8/1993 | Imaizumi et al. | 84/618 |
| 5,296,644 | 3/1994 | Aoki | 84/637 |
| 5,302,777 | 4/1994 | Okuda et al. | 84/637 |
| 5,451,709 | 9/1995 | Minamitaka | 84/609 |
| 5,510,572 | 4/1996 | Hayashi et al. | 84/609 |

*Primary Examiner*—Stanley J. Witkowski
*Attorney, Agent, or Firm*—Graham & James LLP

[57] ABSTRACT

An electronic musical apparatus having a performance information analyzer for automatically analyzing a performance information of a musical tune into a plurality of performance parts, wherein the analyzer is designed to be applied with a performance information including a plurality of tone pitch informations for detecting a performance style of the performance information and for analyzing the performance information into a plurality of performance parts in accordance with the detected performance style.

15 Claims, 10 Drawing Sheets

(ARPEGGIO)

(CHORD)

ELECTRONIC MUSICAL APPARATUS CAPABLE OF AUTOMATICALLY ANALYZING PERFORMANCE INFORMATION OF A MUSICAL TUNE

RELATED APPLICATION

This is a continuation of application Ser. No. 08/319,616, filed Oct. 7, 1994, now abandoned.

BACKGROUND OF THE INVENTION

1. Field of the Invention

The present invention relates to an electronic musical apparatus which includes a performance information analyzer for analyzing a performance information including a plurality of tone pitch informations of a musical tune into a plurality of performance parts, and more particularly to an electronic musical apparatus of the type which includes a chord detection device associated with the performance information analyzer for detecting a chord on a basis of the analyzed performance parts.

2. Description of the Prior Art

In recent years, there has been proposed an electronic musical instrument for harmonizing automatic accompaniment with performance played on a keyboard. In this kind of electronic musical instruments, chord performance of the accompaniment tone is effected on a basis of a performance information applied from the keyboard or key-codes of depressed keys of the keyboard. In general, melody performance is played at a higher tone area of the keyboard where mainly key-codes of non-chord tones relative to the chord are detected. For this reason, the keyboard is imaginarily divided into a left-hand key area for the lower tone and a right-hand key area for the higher tone so that a chord is detected on a basis of key-codes of depressed keys at the left-hand area.

In the case that a chord is detected on a basis of a tone pitch information such as the key-codes, there is a tone area suitable for detection of the chord. Accuracy of the chord detection is, however, influenced by the tone area. Since the tone area changes in accordance with performance of a musical tune, there has been proposed an electronic musical instrument capable of enhancing accuracy in detection of the chord under control of a manual switch arranged to be operated by a user for changing a boundary between the left-hand key area and the right-hand key area. In the electronic musical instrument, however, the manual switch must be operated by the user during performance of the musical tune, resulting in a difficulty in operation of the manual switch. In addition, the performance itself is restricted since the tone area for performance of each part is limited.

On the other hand, almost all musical tunes can be divided into a plurality of performance parts such as a melody part or a bass part which includes an appropriate performance part for detection of the chord. It is, therefore, able to enhance accuracy in detection of the chord in accordance with the performance part if a performance information can be analyzed into the plurality of performance parts. Assuming that an information for automatic performance can be analyzed into a plurality of performance parts, only a desired performance part can be muted to effect the automatic performance, and a function (so called a minus-one function) capable of harmonizing the keyboard performance with the automatic performance can be provided in a simple manner for practice of the user. Furthermore, in case the performance information could be analyzed into the plurality of performance parts as described below, it would be able to add another melody to the performance information or to substitute another melody for a portion of the performance part for effecting an automatic arrangement.

In the conventional electronic musical instrument, the chord detection is effected in such a manner as described below.

1) A chord is detected only when plural keys have been simultaneously depressed. Although in this case, the chord can be detected in simple performance, it is difficult to accurately detect the chord in normal performance.

2) A chord is detected only when plural keys have been strongly depressed. In this case, the performance becomes unnatural due to strong depression of the keys.

3) A keyboard is imaginarily divided into a left-hand key ares for lower tones and a right-hand key area for higher tones so that a chord is detected on a basis of key-codes of depressed keys in the left-hand key area. In this case, the performance itself is restricted since the key area for performance of each part is limited as described above.

4) A plurality of keyboards are adapted to play a plurality of performance parts, and the performed parts each are processed in a different manner to detect a chord therefrom. In this case, the musical instrument itself becomes costly due to an increase of the keyboards.

SUMMARY OF THE INVENTION

It is, therefore, a primary object of the present invention to provide an electronic musical apparatus which includes a performance information analyzer capable of automatically analyzing a performance information of a musical tune into a plurality of performance parts or musical parts.

A secondary object of the present invention is to provide an electronic musical apparatus which includes a chord detection device associated with the information analyzer for accurately detecting a chord based on the analyzed performance parts in normal performance thereof.

According to the present invention, the primary object of the present invention is accomplished by providing an electronic musical apparatus having a performance information analyzer for automatically analyzing a performance information of a musical tune into a plurality of performance parts, wherein the performance information analyzer comprises input means arranged to be applied with a performance information including a plurality of tone pitch informations, detection means for detecting performance style of the performance information, and analyzing means for analyzing the performance information into a plurality of performance parts in accordance with the detected performance style.

The secondary object of the present invention is accomplished by providing an electronic musical apparatus having a performance information analyzer for automatically analyzing a performance information of a musical tune into a plurality of performance parts and a chord detection device for detecting a chord from the performance information, wherein the performance information analyzer comprises input means arranged to be applied with a performance information including a plurality of tone pitch informations, detection means for detecting performance style of the performance information, and analyzing means for analyzing the performance information into a plurality of performance parts in accordance with the detected performance style, and wherein the chord detection device comprises means for detecting a chord on a basis of the analyzed performance parts.

BRIEF DESCRIPTION OF THE DRAWINGS

Other objects, features and advantages of the present invention will be more readily appreciated from the following detailed description of a preferred embodiment thereof when taken together with the accompanying drawings, in which:

FIG. 2(B) illustrates an example of chord style performance;

DESCRIPTION OF THE PREFERRED EMBODIMENT

Figure 1:
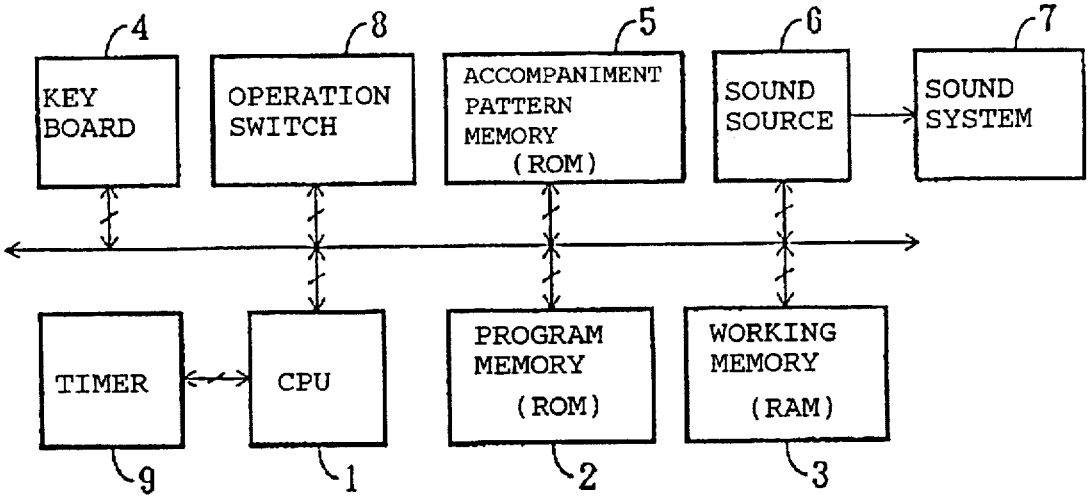
FIG. 1 is a block diagram of an electronic musical instrument provided with a performance information analyzer in accordance with the present invention.

In FIG. 1 of the drawings, there is schematically illustrated a block diagram of an electronic musical signal processing system in the form of an electronic musical instrument which is provided with a performance information analyzer and a chord detection device in accordance with the present invention. The electronic musical instrument includes a central processing unit or CPU 1 arranged to use a working area of a working memory 3 for executing a control program stored in a program memory 2 in the form of a read-only memory. The electronic musical instrument has a keyboard 4 to be played by a user for keyboard performance. The CPU 1 analyzes a performance information applied thereto from the keyboard 4 into a plurality of performance parts and detects a chord on a basis of the analyzed performance parts for effecting automatic accompaniment based on the detected chord and accompaniment patterns memorized in an accompaniment pattern memory 5. The accompaniment pattern memory 5 is arranged to memorize a plurality of accompaniment patterns in accordance with the style of a musical tune and a performance mode.

When applied with a key-code together with a key-on signal or a key-off signal in response to depression or release of keys on the keyboard 4, the CPU 1 applies the key-code with a note-on or a note-off to a sound source 6 for generating or muting a musical tone in accordance with the keyboard performance. The sound source 6 produces a musical tone signal in accordance with the applied key-code and applies it to a sound system 7 where the musical tone signal is converted into an analog signal and amplified to be generated as a musical sound.

The electronic musical instrument has an operation switch assembly 8 which includes various switches such as a start/stop switch for designating start or stop of the automatic accompaniment, a tonality switch for setting a tonality, a set switch for setting the style selection of the automatic accompaniment and for setting a performance tempo, a tone color switch for setting a tone color at the sound source 6 and the like. The CPU 1 is arranged to read out each operation event of the switches and executes processing of the operation event. The CPU 1 is also arranged to set the selected tempo in a timer 9 which produces ninety six tempo clock signals respectively for one measure and applies an interruption signal to the CPU 1 in response to the tempo clock signals. When applied with the interruption signal from the tinier 9, the CPU 1 executes interruption processing for detecting a performance style based on the key-code and for conducting a group analysis for allotment of the key-code to the performance parts. Thus, the CPU 1 detects a chord on a basis of a resultant of the group analysis at each interruption processing and reads out an accompaniment pattern from the accompaniment pattern memory 5 for converting a key-code of the accompaniment pattern in tone pitch in accordance with the detected chord. The key-code converted in tone pitch and the note-on or note-off are applied to the sound source 6. In addition, the CPU 1 is arranged to count the tempo clock signals from start of the automatic accompaniment for detecting a timing of a strong beat or weak beat in a measure and a timing of a measure line (a measure head).

In the group analysis of the performance parts, a key-depression tone of the keyboard 4 is analyzed into a melody part for providing a melody at a higher part, a melody chord part for adding a harmony to the melody, a bass part for providing a bass at a lower part and a bass chord part for adding a harmony to the bass. The analysis condition of the four performance parts is determined on a basis of plural combinations of the number of depressed keys, presence of a measure head at an instant timing, a strong beat or weak beat tone at the instant timing and an interval relative to a previous bass part which correspond with each performance style such as an arpeggio, a chord, a normal mode or the like. In accordance with these conditions, a performance part which an instant key-code belongs to is determined. Accordingly, the four performance parts will change in accordance with a performance information.

Illustrated in FIG. 2(A) is an example of arpeggio style performance and in FIG. 2(B) is an example of chord style performance. In the arpeggio style performance, chord constituent notes tend to be played dispersively. In the chord style performance, the chord constituent notes tend to be simultaneously played. Accordingly, a performance style can be detected by determination of a block chord caused by simultaneous depression of plural keys as in the chord style performance. With respect to a bass tone, it is musically preferable that in the arpeggio style performance, not only the root of the chord is adapted as the bass tone but also the strong beat tone is adapted as the bass tone. It is also musically preferable that in the chord style performance, the root of the chord is adapted as the bass tone. In this embodiment, therefore, the selection of the bass tone is switched over in accordance with the performance style. For instance, the arpeggio style performance is effected by a slide style performance where the bass tone is played at the strong beat and the block chord is performed at the weak beat.

In the analysis of the key-code, each relationship of the four performance parts with the key-code is represented by the following list (1).

$$||a_1|, |b_1, b_2, \ldots|, |c_1, c_2, \ldots|, |d_1, d_2, \ldots|| \quad (1)$$

where "| |" designates a parenthesis of each element of the list, "," designates a period of the respective elements, $a_1$ is a key code of the bass part, $b_1, b_2 \ldots$ designate each key code of the bass chord part, $c_1, c_2 \ldots$ designate each key code of the melody chord part, $d_1, d_2 \ldots$ designate each key code of the melody part, and the entirety of the formula (1) represents a whole list (hereinafter simply referred to a whole analysis list) of the key codes for the respective performance parts.

If there is a key-code in the bass chord part while the key-code is allotted to the respective performance parts in accordance with progression of the performance, a chord is detected on a basis of the bass chord part. If there is not any key-code in the bass chord part, a chord is detected on a basis of a key-code of the melody chord part. If there is not any key-code in the melody chord part, a chord is detected on a basis of a key-code of the melody part.

Figure 3:
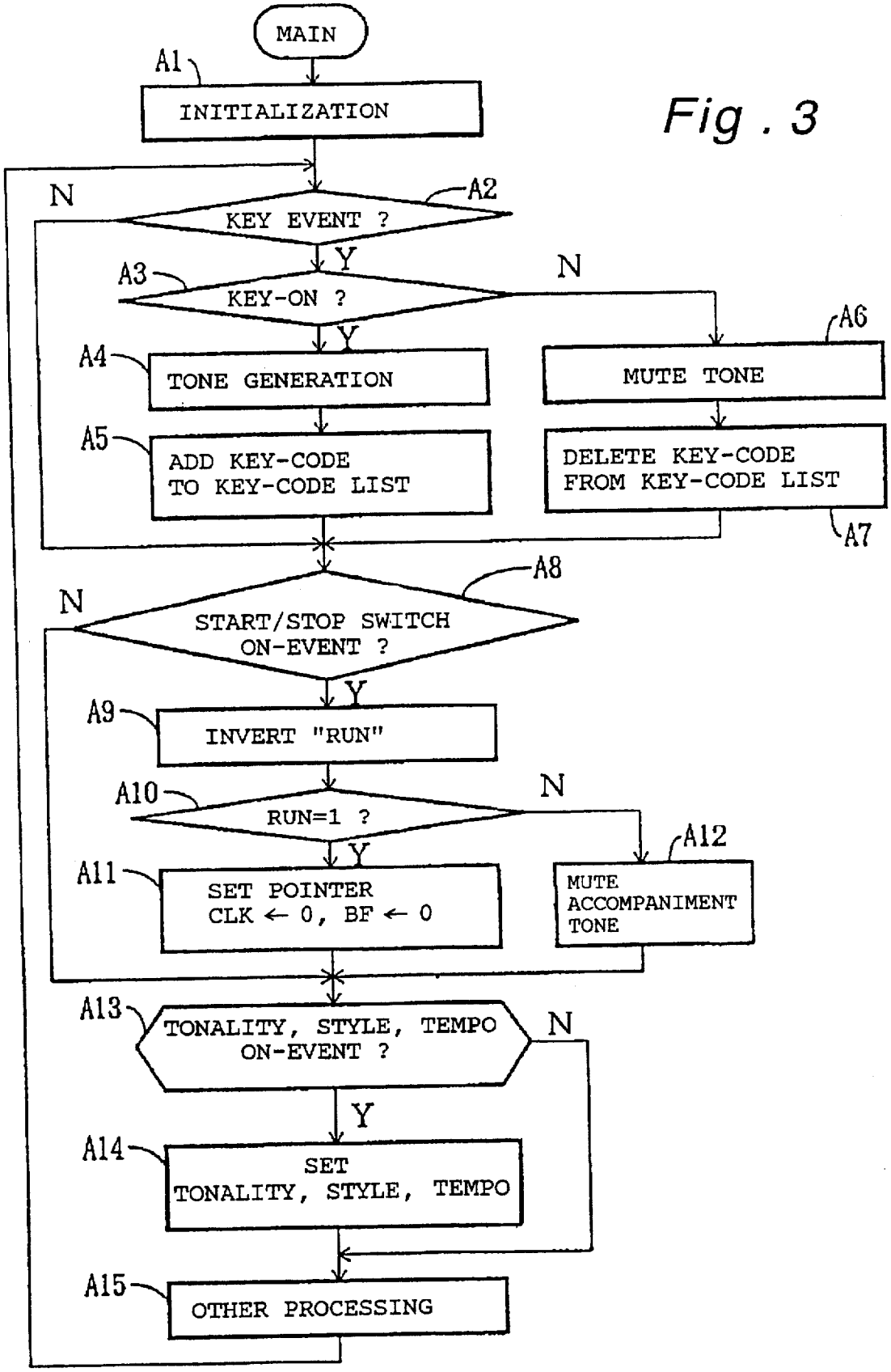
FIG. 3 is a flow chart of a main routine of a control program executed by a central processing unit shown in FIG. 1.

Illustrated in FIG. 3 is a flow chart of a main routine of a control program to be executed by the CPU 1. Each flow chart of sub-routines and an interruption routine of the control program is illustrated in FIGS. 4 to 11. Hereinafter, operation of the electronic musical instrument will be described in detail with reference to the flow charts. In the following description, a key-code applied from the keyboard is simply referred to "an input tone", and a key-code indicative of each element of the listed performance parts is simply referred to "a detection tone". In the flow charts, the bass part, the bass chord part, the melody chord part and the melody part are simply represented by "B part", "BC part", "MC part" and "M part", respectively. Furthermore, respective registers, flags and lists in the following description are represented as listed below.

BCB: Previous input tone,

BS: Bass tone,

BF: Block flag,

CLK: Tempo clock, mode: Flag indicative of performance style or mode (A=Arpeggio, C=Chord, N=Normal), NT: Input tone, Nt: Input tone to be analyzed in the one-note part analysis, NTL: Lower tone of depressed keys in the three-note part analysis, NTM: Medium tone of depressed keys in the three-note part analysis, NTH: Higher tone of depressed keys in the three-note part analysis, PB: Previous bass part, PBC: Previous bass chord part, PMC: Previous melody chord part, PM: Previous melody part, PBCTP: Highest note of a previous bass chord part, PMBT: Lowest note of previous melody chord and melody parts, RUN: Flag indicative of start or stop of automatic accompaniment.

When the electronic musical instrument is connected to an electric power source, the CPU 1 is activated to initiate execution of the main routine shown in FIG. 3. At step A1, the CPU 1 initializes respective flags and variables in the registers and causes the program to proceed to step A2 where the CPU 1 determines a key event on the keyboard 4. If there is not any key event, the CPU 1 causes the program to proceed to step A8. If there is a key event on the keyboard, the program proceeds to step A3 where the CPU 1 determines whether the key event is a key-on event or not. If the answer at step A3 is "Yes", the program proceeds to step A4 where the CPU 1 executes processing for generation of a musical tone. At the following step A5, the CPU 1 enters a key-code into the key-code list and causes the program to proceed to step A8. If the answer at step A3 is "No", the program proceeds to step A6 where the CPU 1 executes processing for mute of the musical tone. At the following step A7, the CPU 1 deletes the key-code from the key-code list and causes the program to proceed to step A8.

At step A8, the CPU 1 determines whether the start/stop switch has been operated or not. If the answer at step A8 is "No", the program proceeds to step A13. If the answer at step A8 is "Yes", the CPU 1 inverts the flag RUN at step A9 and determines at step A10 whether the flag RUN is "1" or not. If the answer at step A10 is "Yes", the program proceeds to step All where the CPU 1 sets a read out pointer of the accompaniment patterns and resets the tempo clock CLK and block flag BF. If the answer at step A10 is "No", the program proceeds to step A12 where the CPU 1 mutes the accompaniment tone and causes the program to proceed to step A13.

At step A13, the CPU 1 detects each operation event of the tonality setting switch, the style selection switch and the tempo setting switch in the operation switch assembly 8. If there is an operation event of one of the switches, the program proceeds to step A14 where the CPU 1 executes processing for setting of the operated switch. Subsequently, the CPU 1 executes other processing at step A15 and returns the program to step A2. With the foregoing processing, generation or mute of a musical tone in performance of the keyboard is effected, and start or stop of the automatic accompaniment and setting of the tonality, style selection and tempo are effected.

Figure 4:
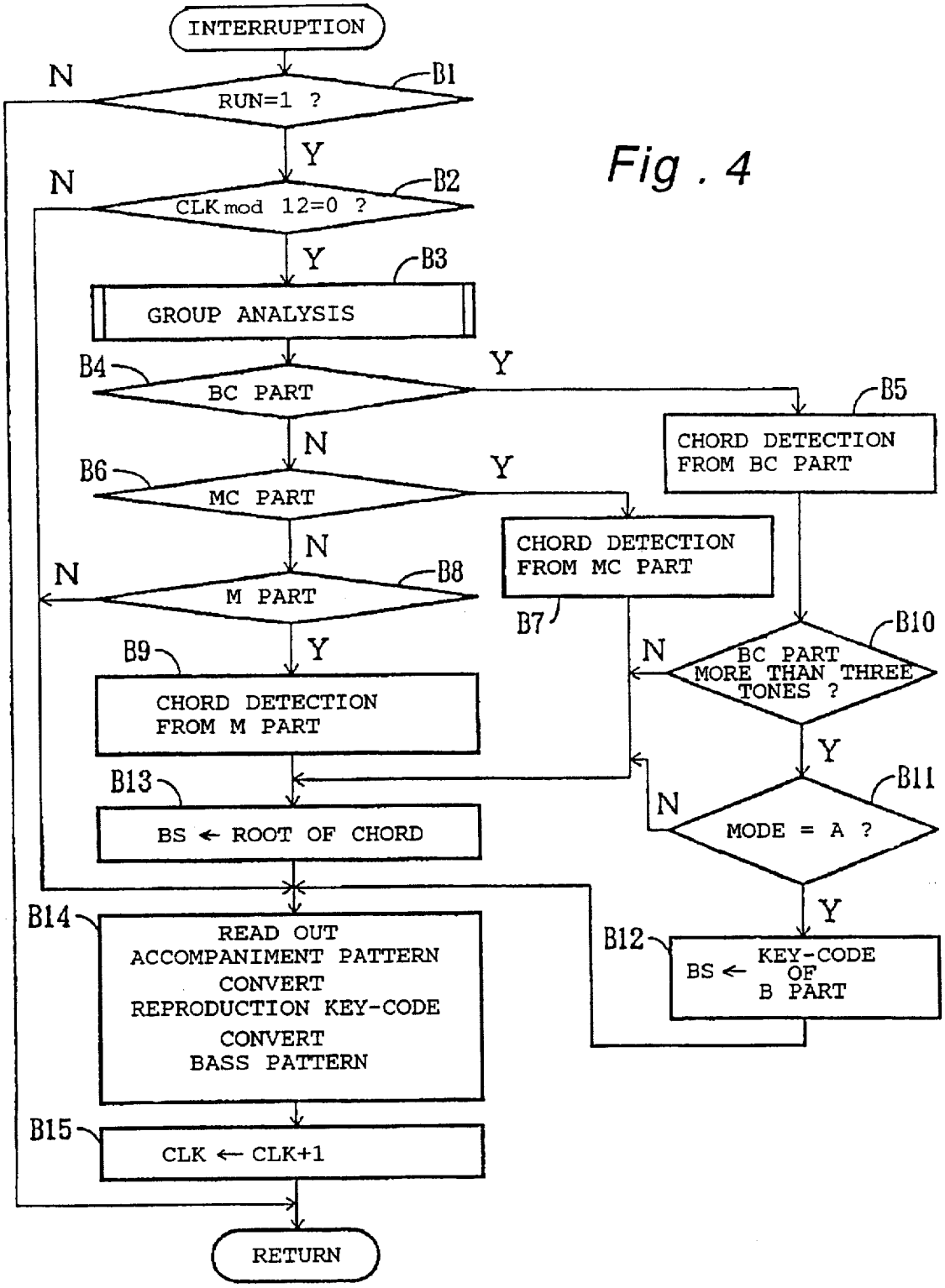
FIG. 4 is a flow chart of an interruption routine of the program executed by the central processing unit.

When activated by a tempo clock signal applied from the timer 9, the CPU 1 initiates execution of the interruption routine shown in FIG. 4. At step B1, the CPU 1 determines whether the flag RUN is "1" or not. If the answer at step B1 is "No", the program returns to the main routine. If the answer at step B1 is "Yes", the program proceeds to step B2 where the CPU 1 determines whether "CLK mod 12" is "0" or not. If the answer at step B2 is "No", the program proceeds to step B14. If the answer at step B2 is "Yes", the program proceeds to step B3 where the CPU 1 executes processing of a group analysis shown in FIG. 5 for detecting a chord on a basis of a resultant of the group analysis at the following step B4 to B13. The processing of the group analysis and the chord detection will be conducted at every 8th-note.

After the group analysis has finished at step B3, the CPU 1 determines at step B4 whether a detection tone of the bass chord part is present or not. If the answer at step B4 is "Yes", the program proceeds to step B5 where the CPU 1 detects a chord based upon a key-code of the bass chord part. If the answer at step B4 is "No", the program proceeds to step B6 where the CPU 1 determines whether a detection tone of the melody chord part is present or not. If there is a detection tone of the melody chord part, the CPU 1 determines a "Yes" answer at step B6 and detects at step B7 a chord based upon a key-code of the melody chord part. If the answer at step B6 is "No", the program proceeds to step B8 whether the CPU 1 determines whether a detection tone of the melody part is present or not. If there is a detection tone of the melody part, the CPU 1 determines a "Yes" answer at step B8 and detects a chord based upon a key-code of the melody part at the following step B9. If there is not any detection tone in the melody part, the CPU 1 maintains a previous chord and causes the program to proceed to step B14.

When the chord based upon the bass chord part has been detected, the program proceeds to step B10 where the CPU 1 determines whether or not there are more than three tones in the bass chord part. If the answer at step B10 is "Yes", the program proceeds to step B11 where the CPU 1 determines whether the performance style or mode is an arpeggio or not. If the answer at step B11 is "Yes", the program proceeds to step B12 where the CPU 1 stores the key-code of the bass part as BS in the register and causes the program to proceed to step B14. If a "No" answer is determined respectively at step B10, B11 or the chord is detected on a basis of the melody part at step B9, the program proceeds to step B13 where the CPU 1 stores the root of the detected chord as BS in the register and causes the program to proceed to step B14.

Figure 2:
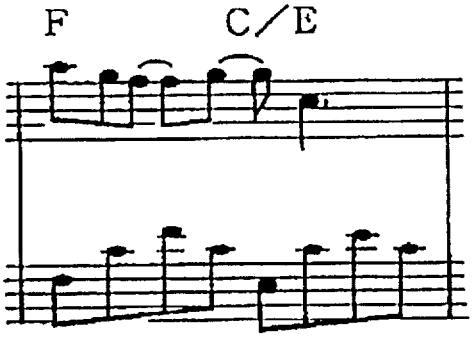
FIG. 2(*a*) illustrates an example of arpeggio style performance.
Figure 2:
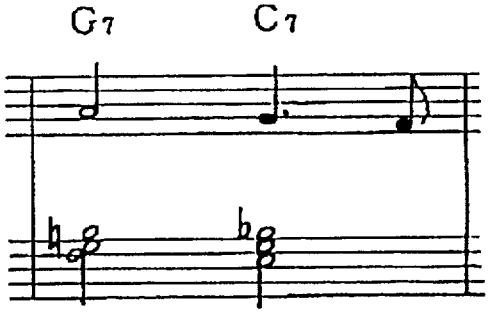

With the foregoing processing, each detection tone of the bass chord part and the melody chord part is adapted for detection of the chord on a basis of the whole analysis list obtained by the group analysis so that the chord detection is effected in the order of the bass chord part, the melody chord part and the melody part. In the case that the detection tones of the bass chord part are more than three tones and that the performance style or mode is an arpeggio, the key-code of the bass part is adapted as the bass tone BS. In other cases, the root of the detected chord is adapted as the bass tone BS. That is to say, as shown in FIG. 2, the first tone is adapted as the bass tone in the arpeggio style performance, and the root of the chord is adapted as the bass tone in the chord style performance.

When the program proceeds to step B14, the CPU 1 reads out an accompaniment pattern based upon the style, mode and tempo clock CLK to reproduce the accompaniment pattern. The accompaniment pattern is selected in accordance with instant style and performance mode and is read out in response to the tempo clock CLK. The key-code of the accompaniment pattern is converted in tone pitch in accordance with a tonality and the detected chord to be reproduced. The bass pattern is also converted in tone pitch in accordance with the bass tone BS to be reproduced. At the following step B15, the CPU 1 increments the tempo clock CLK with "1" and returns the program to the main routine.

Figure 5:
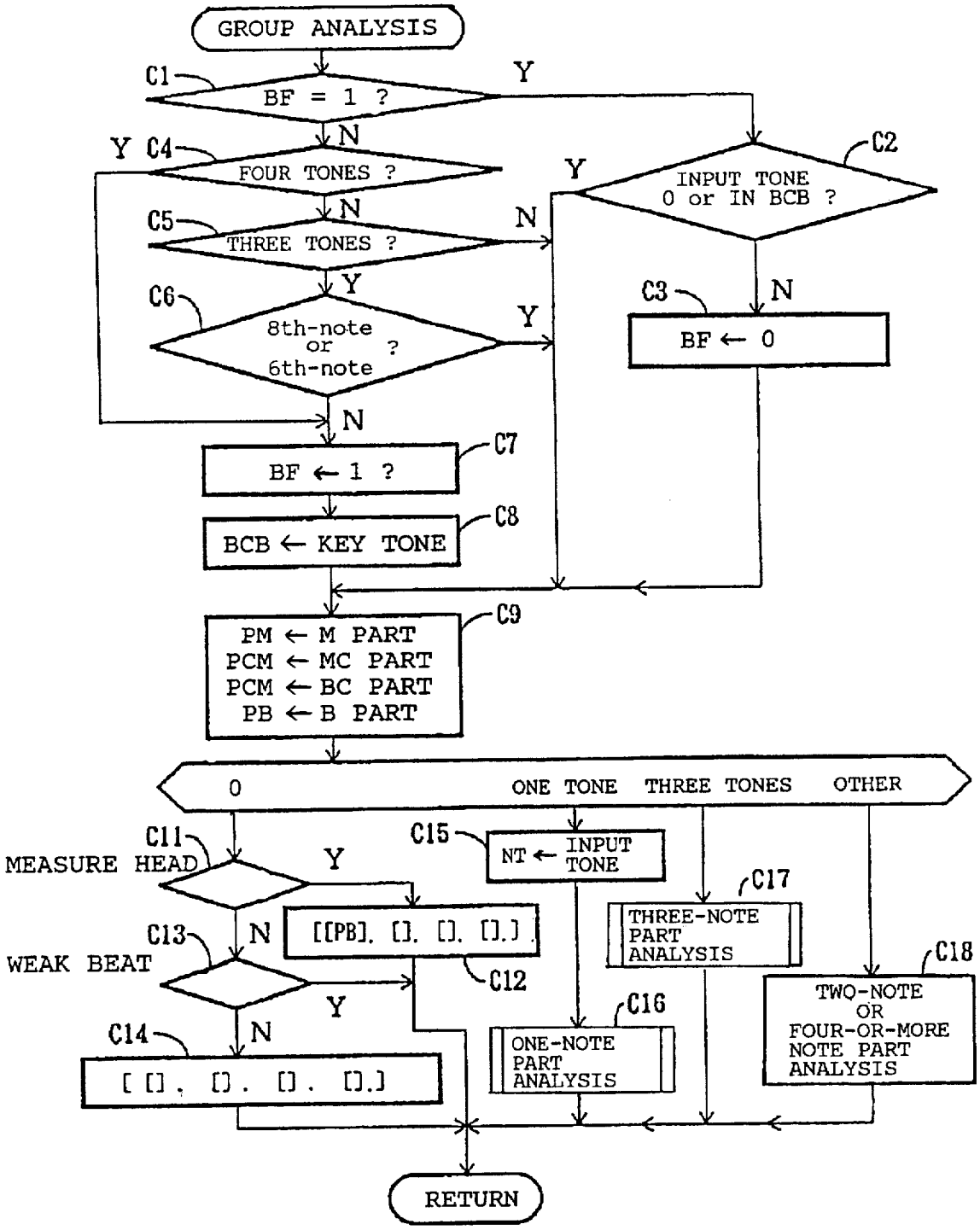
FIG. 5 is a flow chart of a group analysis routine of the program.

In the group analysis shown in FIG. 5, the CPU 1 determines at step Cl whether the block flag BF is "1" or not. If the answer at step C1 is "Yes", the CPU 1 determines at step C2 whether or not the number of input tones is "0" or whether or not the input tones are included in previous input tones BCB. If the answer at step C2 is "Yes", the program proceeds to step C9. If the answer at step C2 is "No", the program proceeds to step C3 where the CPU 1 resets the block flag BF and causes the program to proceed to step C9. That is to say, the CPU 1 maintains the block flag BF as "1" when the instant input tone is not included in the previous block chord or included in the previous input tone and resets the block flag BF when the input tone is newly applied.

If the answer at step C1 is "No", the program proceeds to step C4 where the CPU 1 determines whether or not the number of input tones is more than four tones. If the answer at step C4 is "Yes", the program proceeds to step C7. If the answer at step C4 is "No", the program proceeds to step C5 where the CPU 1 determines whether the number of input tones is three tones or not. If the answer at step C5 is "No", the program proceeds to step C9. If the answer at step C5 is "Yes", the program proceeds to step C6 where the CPU 1 determines whether or not an interval of higher two tones is an 8th or 6th interval apart. If the answer at step C6 is "Yes", the program proceeds to step C9. If the answer at step C6 is "No", the CPU 1 sets the block flag BF as "1" at step C7, stores the instant input tones as BCB in the register at step C8 and causes the program to proceed to step C9.

With the foregoing processing, a block chord is determined when the input tones are more than four tones, and the block chord is conditionally determined when the input tones are three tones. For instance, when a single bass tone and two melody tones are simultaneously played (when an interval of higher two tones is an 8th or 6th interval apart), the block chord may not be determined.

At step C9, the CPU 1 stores the detection tone (the melody tone) of the previous melody part PM in the list and stores the detection tone (the melody chord tone) of the previous melody chord part PMC in the list. In addition, the CPU 1 stores the detection tone (the bass chord tone) of the previous bass chord part PBC in the list and stores the detection tone (the bass tone) of the previous bass part PB in the register. Thus, the resultant of the previous analysis is memorized in the respective lists and register, and the program proceeds to step C10.

At step C10, the CPU 1 detects the number of input tones. If the number of input tones is "0", the CPU 1 executes processing at the following step C11 to C14. If the number of input tones is "1", the CPU 1 stores the input tone NT in the register at step C15 and executes at step C16 processing of a one-note part analysis shown in FIG. 6. If the number of input tones is three tones, the CPU 1 executes at step C17 processing of a three-note part analysis shown in FIG. 10. In other cases, the CPU 1 executes at step C18 processing of a two-note part analysis or a four-or-more note part analysis and returns the program to the main routine.

At step C11, the CPU 1 determines whether an instant timing is a measure head or not. If the answer at step C11 is "Yes", the program proceeds to step C12 where the CPU 1 sets the whole analysis list as [[PB], [], [], []] for making only the previous bass tone effective and returns the program to the main routine. If the answer at step C11 is "No", the program proceeds to step C13 where the CPU 1 determines whether the instant timing is a weak beat or not. If the answer at step C13 is "Yes", the program returns to the main routine. If the instant timing is a strong beat, the CPU 1 determines a "No" answer at step C13 and causes the program to proceed to step C14 where the CPU 1 sets the whole analysis list as [ [], [], [], ]] and returns the program to the main routine.

Figure 6:
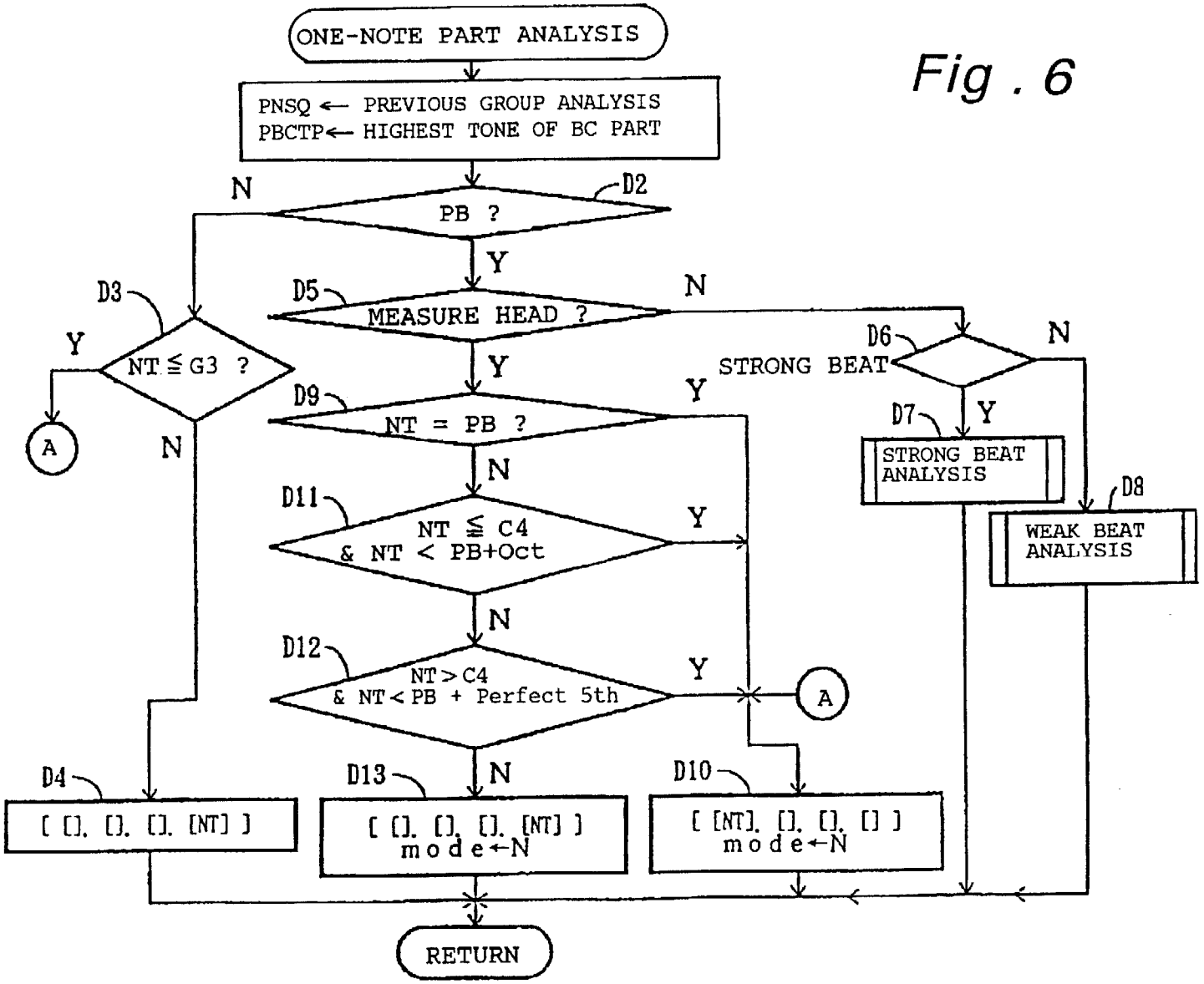
FIG. 6 is a flow chart of a one-note part analysis routine of the program.

In processing of the one-note part analysis shown in FIG. 6, the CPU 1 stores at step D1 a resultant of a previous analysis as PNSQ in the list and a highest tone of the bass chord part as PBCTP in the register. At the following step D2, the CPU 1 determines whether a previous bass tone PB is present or not. If the answer at step D2 is "No", the program proceeds to step D3 where the CPU 1 determines whether "Nt≦G3 code" is satisfied or not. If "Nt≦G3 code" is satisfied at step D3, the program proceeds to step D10 where the CPU 1 sets the whole analysis list as [[NT], [], [], []] and the performance style or mode as a normal mode N and returns the program to the main routine. If the answer at step D3 is "No", the program proceeds to step D4 where the CPU 1 sets the whole analysis list as [[], [], [], [NT]] and returns the program to the main routine.

If there is a previous bass tone PB at step D2, the CPU determines at step D5 whether the instant timing is a measure head or not. If the answer at step D5 is "Yes", the CPU 1 executes processing at the following step D9. If the answer at step D5 is "No", the CPU 1 determines at step D6 whether the instant timing is a strong beat or not. If the answer at step D6 is "Yes", the CPU 1 executes at step D7 processing of a strong beat analysis shown in FIG. 7 and returns the program to the main routine. If the answer at step D6 is "No", the CPU 1 executes at step D8 processing of a weak beat analysis shown in FIG. 8 and returns the program to the main routine.

If the instant timing is a measure head, the program proceeds to step D9 where the CPU 1 determines whether the input tone NT is identical with the previous bass tone PB or not. If the answer at step D9 is "Yes", the CPU 1 executes processing at step D10 as described above. If the answer at step D9 is "No", the CPU 1 determines at step D11 whether "Nt≦C4 code" and "Nt<PB +12" are satisfied or not. If the answer at step D11 is "Yes", the CPU 1 executes processing at step D10 as described above. If the answer at step D11 is "No", the CPU 1 determines at step D12 whether "Nt>C4 code" and "Nt<PBS +Perfect 5th" are satisfied or not. If the answer at step D12 is "Yes", the CPU 1 executes processing at step D10. If the answer at step D12 is "No", the program proceeds to step D13 where the CPU 1 determines the input tone NT as a melody tone and sets at step D13 the whole analysis list as [[]. []. []. [NT]] and the performance style or mode as a normal mode (N).

From the above description, it will be understood that if there is not any previous tone in the one-note part analysis, the input tone is allotted to the bass part or the melody part by comparison with the G3 code. If there is a previous tone in the one-note part analysis, the input tone is analyzed in accordance with an instant timing. If the instant timing is a measure head, the input tone is allotted to the bass part or the melody part in accordance with the previous bass tone PBS and the C4 code. If the instant timing is not a measure head under presence of the previous bass tone, the instant timing is analyzed in accordance with the strong beat timing or the weak beat timing.

Figure 7:
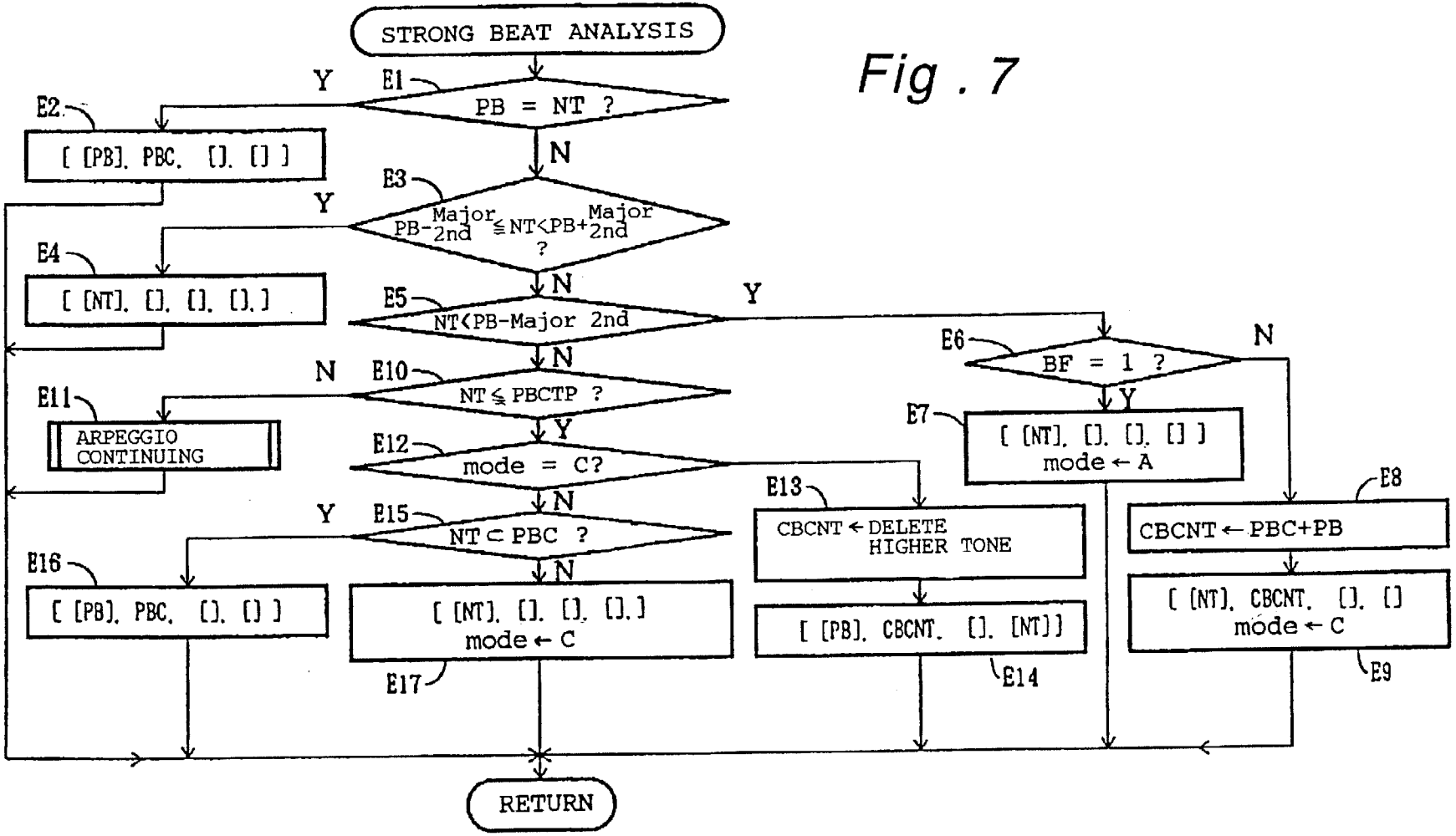
FIG. 7 is a flow chart of a strong beat analysis routine of the program.

In processing of the strong beat analysis shown in FIG. 7, the CPU 1 determines at step El whether the input tone NT is identical with the previous bass tone PB or not. If the answer at step El is "Yes", the CPU 1 sets the whole analysis list as [[PB]. PBC. []. []] and returns the program to the main routine. If the answer at step El is "No", the CPU 1 determines at step E3 whether "PB−Interval of Major 2nd≦NT<PB+Interval of Major 2nd" is satisfied or not. If the input tone is adjacent to the previous bass tone, the CPU 1 determines a "Yes" answer at step E3 and sets at step E4 the whole analysis list as [[NT]. []. []. []]. If the answer at step E3 is "No", the CPU 1 determines at step E5 whether "NT<PB−Interval of Major 2nd" is satisfied or not. If the answer at step E5 is "Yes", the CPU 1 causes the program to proceed to step E6. If the answer at step E5 is "No", the CPU 1 causes the program to proceed to step E10.

At step E6, the CPU 1 determines whether the block flag BF is "1" or not. If the answer at step E6 is "Yes", the program proceeds to step E7 where the CPU 1 sets the whole analysis list as [[NT]. []. []. []] and the performance style or mode as an arpeggio A. If the answer at step E6 is "No", the program proceeds to step E8 where the CPU 1 adds the previous bass tone PB to the previous bass chord part PBC and stores it as CBCNT in the list. At the following step E9, the CPU 1 sets the whole analysis list as [[NT]. CBCNT. []. []] and the performance style or mode as a chord C.

When the program proceeds to step E10, the CPU 1 determines whether "NT≦PBCTP" is satisfied or not. If the answer at step E10 is "Yes", the CPU 1 causes the program to proceed to step E12. If the input tone NT is higher than the highest tone of the previous bass chord part, the CPU 1 determines a "No" answer at step E10 and causes the program to proceed to step E11. At step E11, the CPU 1 executes processing of the arpeggio continuing routine shown in FIG. 9 and returns the program to the main routine. At step E12, the CPU 1 determines whether the performance style or mode is "C" or not. If the answer at step E12 is "Yes", the CPU 1 determines the input tone as a melody tone and deletes at step E13 a higher tone than the input tone from the previous bass chord part PBC and stores it as CBCNT in the list. At the following step E14, the CPU 1 sets the whole analysis list as [[PB]. CBCNT. []. [NT]] and returns the program to the main routine. If the answer at step E12 is "No", the CPU 1 determines at step 15 whether the input tone NT is included in the previous bass chord part PBC or not. If the input tone NT is included in the previous bass chord part PBC, the CPU 1 determines a "Yes" answer at step E15 and causes the program to proceed to step E16. At step E16, the CPU 1 sets the whole analysis list as [[PB]. PBC. []. []] and returns the program to the main routine. If the answer at step E15 is "No", the CPU 1 determines the input tone as a bass tone and sets at step E17 the whole analysis list as [[NT]. []. []. []] and the performance style or mode as the chord (C).

In the foregoing processing of the strong beat analysis, the processing of the arpeggio continuing is conducted at step E11 when the input tone NT at step E10 is higher than the highest tone PBCTP of the previous bass chord part. Thus, the input tone NT is entered into the bass chord part of the list to expand the bass chord part of the list. In the strong beat analysis, the input tone tends to be determined as the bass part at step E17 when the input tone at step E15 is not included in the previous bass chord part.

Figure 8:
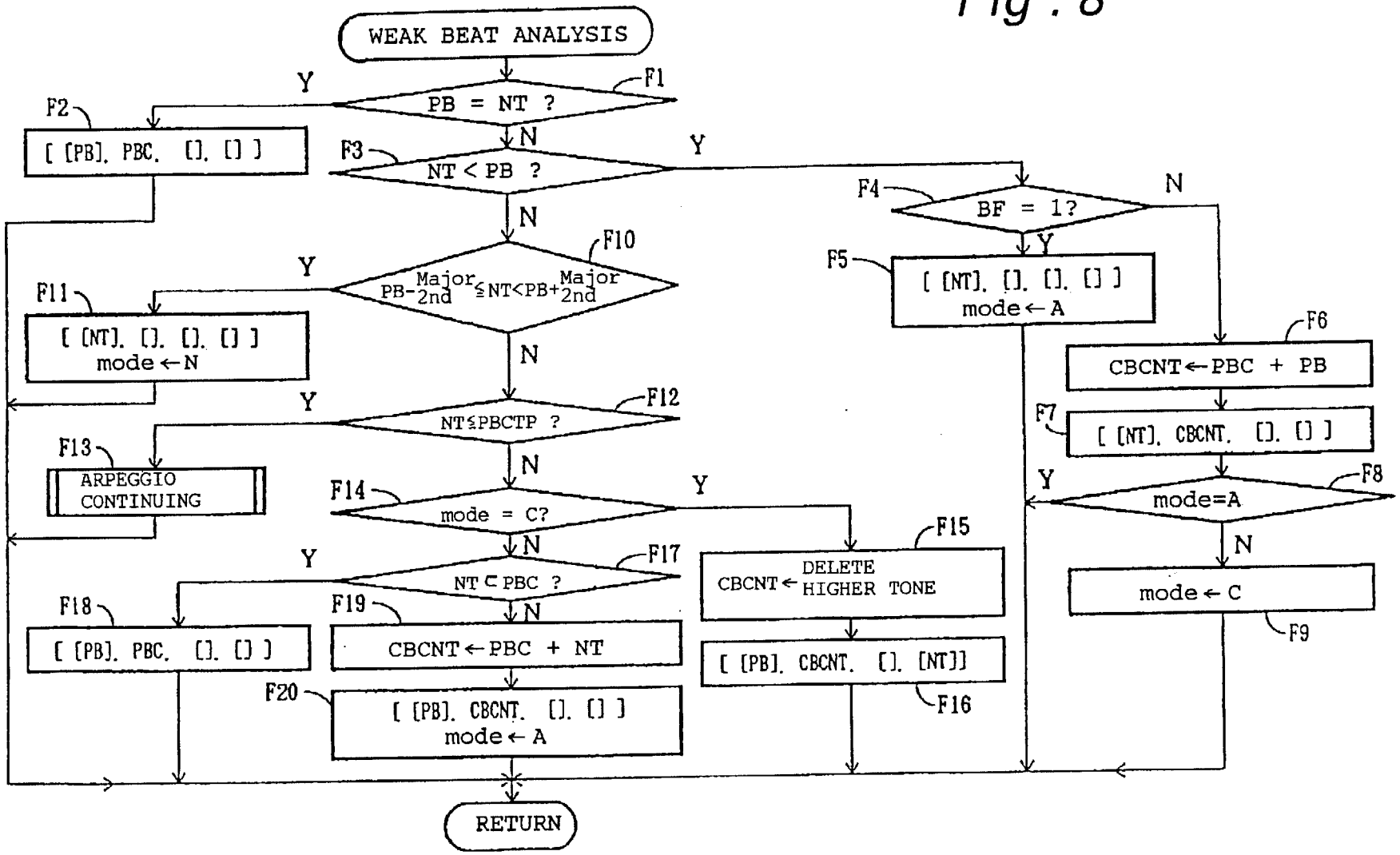
FIG. 8 is a flow chart of a weak beat analysis routine of the program.
Figure 9:
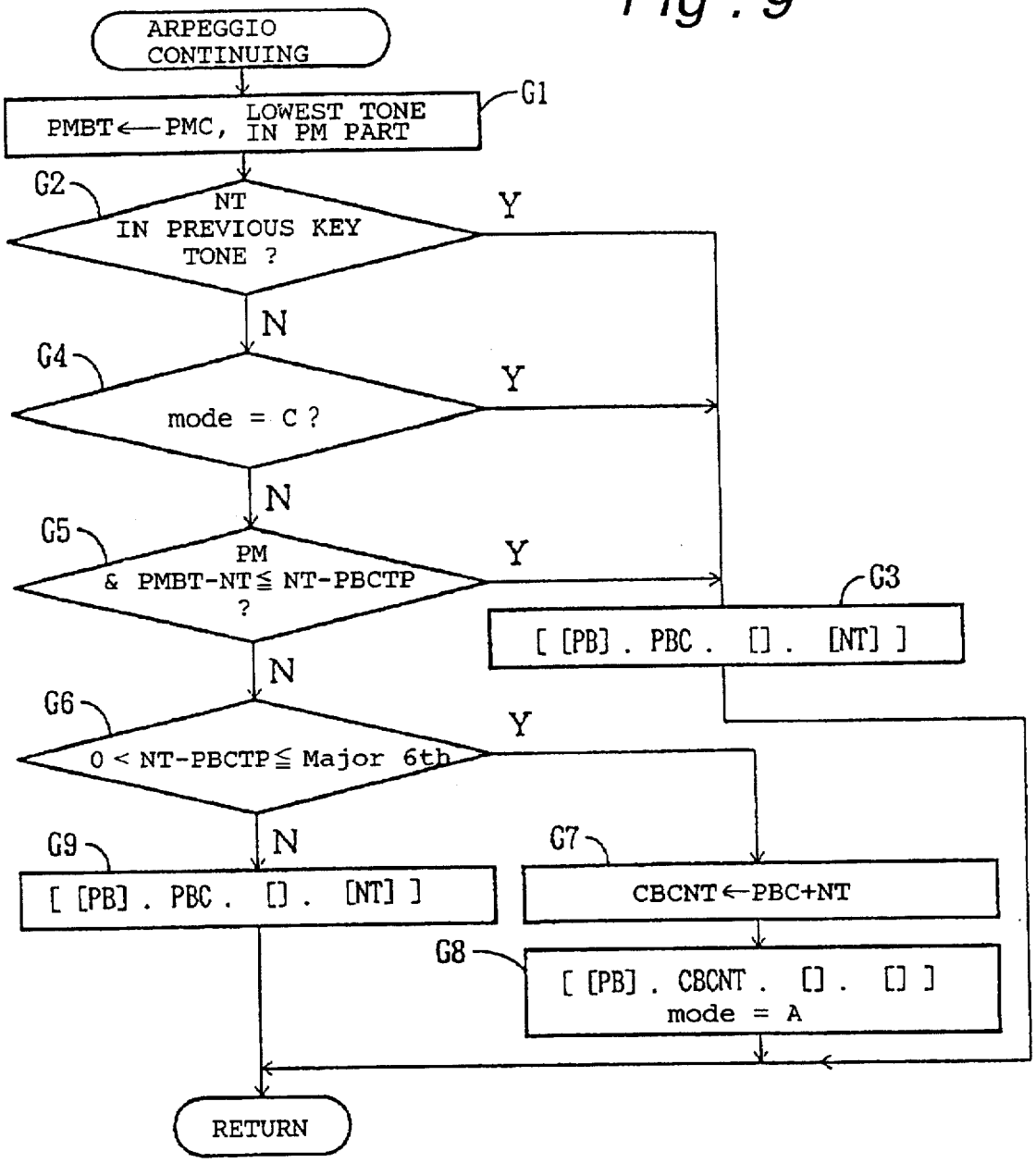
FIG. 9 is a flow chart of an arpeggio continuing routine of the program.

In processing of the weak beat analysis shown in FIG. 8, the CPU 1 determines at step F1 whether the input tone is identical with the previous bass tone PB. If the answer at step F1 is "Yes", the CPU 1 sets at step F2 the whole analysis list as [[PB]. PBC. []. []] and returns the program to the main routine. If the answer at step F1 is "No", the CPU 1 determines at step F3 whether the input tone NT is lower than the previous bass tone PB or not. If the answer at step F3 is "Yes", the program proceeds to step F4. If the answer at step F3 is "No", the program proceeds to step F10. At step F4, the CPU 1 determines whether the block flag BF is "1" or not. If the answer at step F4 is "Yes", the CPU 1 determines the input tone NT as a bass tone and sets at step F5 the whole analysis list as [[NT}. []. []. []] and the performance style or mode as an arpeggio (A). If the answer at step F4 is "No", the program proceeds to step F6 where the CPU 1 enters the previous bass tone PB into the previous bass chord part PBC and stores it as CBCNT in the list. At the following step F7, the CPU 1 sets the whole analysis list as [[NT]. CBCNT. []. []] and causes the program to proceed to step F8. At step F8, the CPU 1 determines whether the performance mode is "A" or not. If the answer at step F8 is "Yes", the CPU 1 returns the program to the main routine. If the answer at step F8 is "No", the program proceeds to step F9 where the CPU 1 sets the performance mode as a chord (C) and returns the program to the main routine.

When the program proceeds to step F10, the CPU 1 determines whether "PB≦NT<PB+Interval of Major 2nd" is satisfied or not. If the answer at step F10 is "No", the program proceeds to step F12. If the input tone NT is in the interval of high major 2nd of the previous bass tone, the CPU 1 determines a "Yes" answer at step F10 and sets at step F11 the whole analysis list as [[NT]. []. []. []] and the performance mode as a normal mode (N). When the program proceeds to step F12, the CPU 1 determines whether "NT PBCTP" is satisfied or not. If the answer at step F12 is "No", the program proceeds to step F14. If the input tone NT is higher than the highest tone of the previous bass chord part, the CPU 1 determines a "Yes" answer at step F12 and executes at step F13 processing of the arpeggio continuing routine shown in FIG. 9. If the program proceeds to step F14, the CPU 1 determines whether the mode is "C" or not. If the answer at step F14 is "Yes", the CPU 1 determines the input tone as a melody tone and deletes at step F15 a higher tone than the input tone NT from the previous bass chord part and stores it as CBCNT in the list. Thus, the CPU 1 sets at step F16 the whole analysis list as [[PB]. CBCNT. []. [NT]] and returns the program to the main routine.

If the answer at step F14 is "No", the program proceeds to step F17 where the CPU 1 determines whether the input tone NT is included in the previous bass chord part PBC or not. If the answer at step F17 is "Yes", the program proceeds to step F18 where the CPU 1 sets the whole analysis list as [[PB]. PBC. []. []] and returns the program to the main routine. If the answer at step F17 is "No", the CPU 1 determines the input tone as a bass tone and causes the program to proceed to step F19. At step F19, the CPU 1 enters the input tone NT into the previous bass chord part PBC and stores it as CBCNT in the list. Thus, the CPU 1 sets at step F20 the whole analysis list as [[NT]. CBCNT. []. []] and the performance mode as the arpeggio (A).

In the foregoing processing of the weak beat analysis, the arpeggio continuing is conducted at step F13 when the input tone at step F12 is higher than the highest tone PBCTP of the previous bass chord part. In this instance, the input tone NT is entered into the bass chord part of the list so that the bass chord part of the list is expanded. In the weak beat analysis, the input tone NT is entered into the bass chord part of the list at step F19 and F20 even when the input tone at step F17 is not included in the previous bass chord part. Thus, the bass chord part of the list is expanded, and the performance mode becomes an arpeggio. Although in the strong beat analysis the input tone NT tends to be determined as the bass tone by processing at step E17, the bass tone is determined as the previous bass tone PB by processing at step F20 of the weak beat analysis. Thus, the bass tone in the weak beat analysis is conditioned to be unchanged.

In processing of the arpeggio continuing, the CPU 1 stores at step G1 the previous melody chord part PMC and the lowest note of the previous melody part as PMBT in the register and determines at step G2 whether the input tone NT is included in a previously depressed key tone or not. If the answer at step G2 is "Yes", the CPU 1 determines the input tone NT as a melody tone and sets at step G3 the whole analysis list as [[PB]. PBC. []. [NT]]. If the answer at step G2 is "No", the CPU 1 determines at step G4 whether the performance mode is "C" or not. If the performance mode is "C", the CPU 1 determines a "Yes" answer at step G4 and causes the program to proceed to step G3. If the answer at step G4 is "No", the CPU 1 determines at step G5 whether there is a previous melody part PM or not and whether "PMBT−NT≦NT−PBCTP" is satisfied or not. If the answer at step G5 is "Yes", the program proceeds to step G3. If the answer at step G5 is "No", the program proceeds to step G6 where the CPU 1 determines whether "0<NT−PBCTP≦Interval of major 6th" is satisfied or not. If the answer at step G6 is "Yes", the program proceeds to step G7 where the CPU 1 enters the input tone NT into the previous bass chord part PBC and stores it as CBCNT in the list. At the following step G8, the CPU 1 sets the whole analysis list as [[PB]. CBCNT. []. []] and the performance mode as the arpeggio (A). Thus, the arpeggio continuing is effected by processing at step G7 and G8. If the answer at step G6 is "No", the program proceeds to step G9 where the CPU 1 sets the whole analysis list as [[PB]. PBC. []. [NT]] and returns the program to the main routine.

Figure 10:
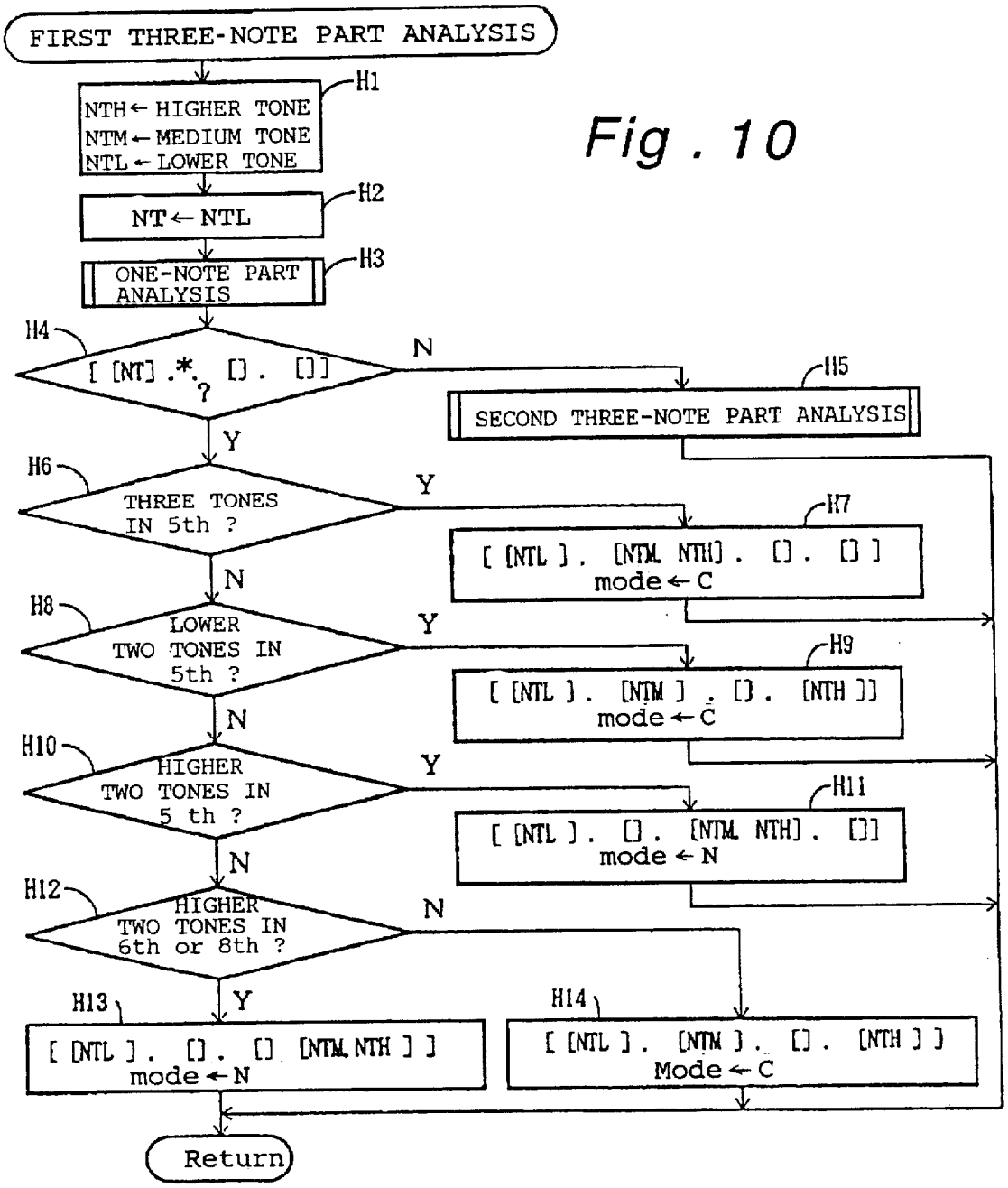
FIG. 10 is a flow chart of a first three-note part analysis routine of the program.

In processing of the first three-note part analysis shown in FIG. 10, the CPU 1 stores at step H1 a higher tone of depressed keys as NTH, a medium tone of depressed keys as NTM and a lower tone of depressed keys as NTL in the register and stores at step H2 the lower tone NTL in the register. At the following step H3, the CPU 1 executes processing of the one-note part analysis shown in FIG. 6. After completion of the one-note part analysis of the lower tone NTL, the CPU 1 determines at step H4 whether or not a resultant of the one-note part analysis satisfies [[NT]. * . []. []]. If the lower tone is a bass tone, the CPU 1 determines a "Yes" answer at step H4 and causes the program to proceed to step H6. If the answer at step H4 is "No", the program proceeds to step H5 where the CPU 1 executes processing of the second three-note part analysis shown in FIG. 11 and returns the program to the main routine.

At step H6, the CPU 1 determines whether each interval of the three tones is in the 5th or not. If the answer at step H6 is "No", the program proceeds to step H8. If the answer at step H6 is "Yes", the program proceeds to step H7 where the CPU 1 sets the whole analysis list as [[NTL]. [NTM. NTH]. []. []] and the performance mode as a chord (C). At step H8, the CPU 1 determines whether the interval of the lower two tones is in the 5th or not. If the answer at step H8 is "No", the program proceeds to step H10. If the answer at step H8 is "Yes", the program proceeds to step H9 where the CPU sets the whole analysis list as [[NTL]. [NTM]. []. [NTH]] and the performance mode as the chord (C). At step H10, the CPU 1 determines whether the interval of the higher two tones is in the 5th or not. If the answer at step H10 is "No", the program proceeds to step H12. If the answer at step H10 is "Yes", the program proceeds to step H11 where the CPU 1 sets the whole analysis list as [[NTL]. []. [NTM. NTH]. []] and the performance mode as a normal mode (N). At step H12, the CPU 1 determines whether or not the interval of the higher two tones is in the 6th or 8th. If the answer at step H12 is "Yes", the program proceeds to step H13 where the CPU 1 sets the whole analysis list as [[NTL]. []. []. [NTM. NTH]] and the performance mode as the normal mode (N). If the answer at step H12 is "No", the program proceeds to step H14 where the CPU 1 sets the whole analysis list as [[NTL]. [NTM]. []. [NTH]] and the performance mode as the chord (C).

Figure 11:
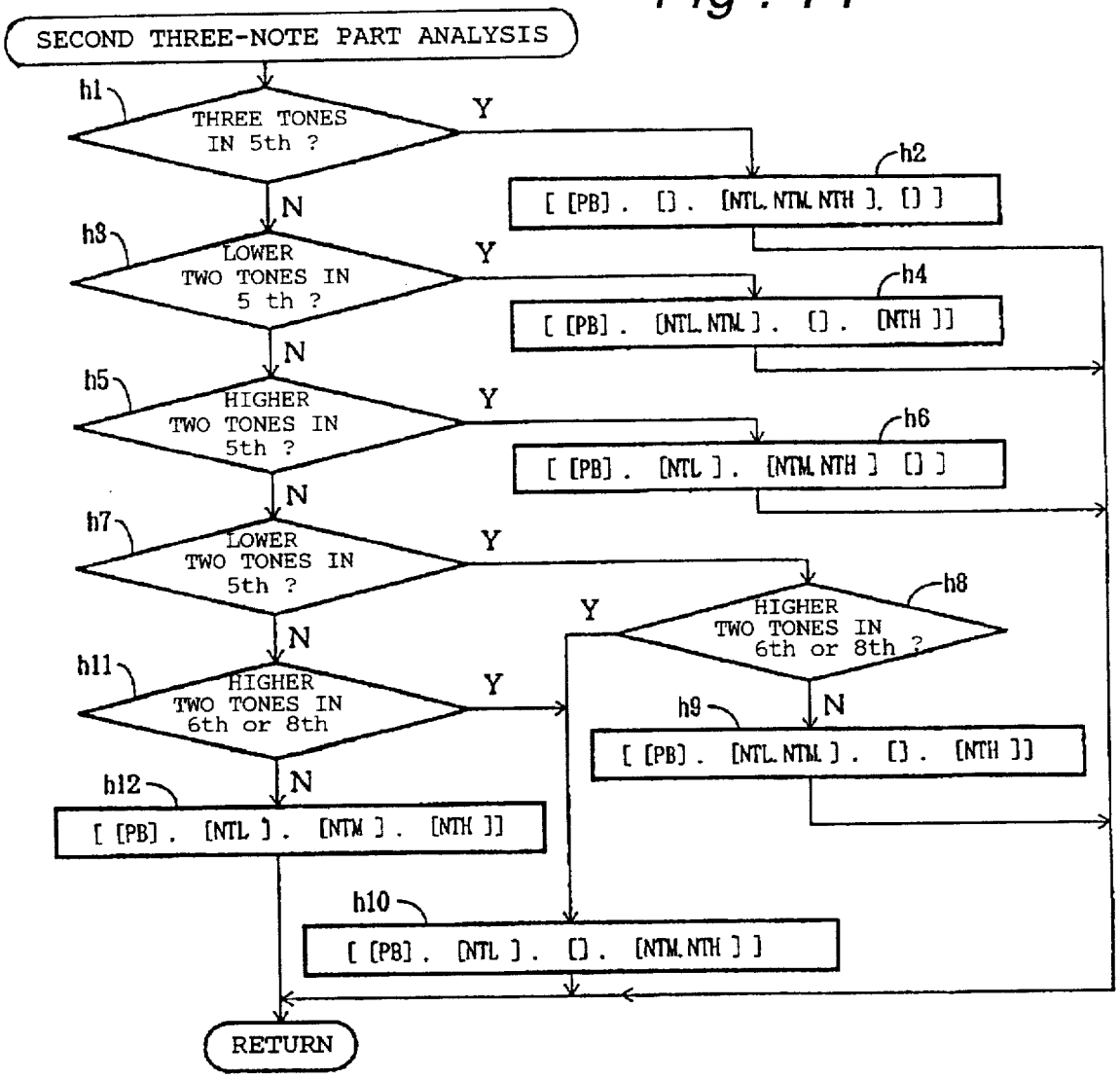
FIG. 11 is a flow chart of a second three-note part analysis routine of the program.

In processing of the second three-note part analysis shown in FIG. 11, the CPU 1 determines at step h1 whether each interval of the three tones is in the 5th or not. If the answer at step h1 is "No", the program proceeds to step h3. If the answer at step h1 is "Yes", the program proceeds to step h2 where the CPU 1 sets the whole analysis list as [[PB]. []. [NTL. NTM. NTH]. []] and returns the program to the main routine. At step h3, the CPU 1 determines whether the interval of the lower two tones is in the 5th or not. If the answer at step h3 is "No", the program proceeds to step h5. If the answer at step h3 is "Yes", the program proceeds to step h4 where the CPU 1 sets the whole analysis list as [[PB]. [NTL. NTM]. []. [NTH]]] and returns the program to the main routine.

At step h5, the CPU 1 determines whether the interval of the higher two tones is in the 5th or not. If the answer at step h5 is "No", the program proceeds to step h7. If the answer at step h5 is "Yes", the program proceeds to step h6 where the CPU 1 sets the whole analysis list as [[PB]. [NTL].

[NTM. NTH]. []] and returns the program to the main routine. At step h7, the CPU determines whether the interval of the lower two tones is in the 8th or not. If the answer at step h7 is "No", the program proceeds to step h11. If the answer at step h7 is "Yes", the program proceeds to step h8 where the CPU 1 determines whether or not the interval of the higher two tones is the 6th or 8th. If the answer at step h8 is "No", the program proceeds to step h9 where the CPU 1 sets the whole analysis list as [[PB]. [NTL. NTM]. []. [NTH]] and returns the program to the main routine. If the answer at step h8 is "Yes", the program proceeds to step h10 where the CPU 1 sets the whole analysis list as [[PB]. [NTL]. []. [NTM. NTH] and returns the program to the main routine.

At step h11, the CPU 1 determines whether or not the interval of the higher two tones is the 6th or 8th. If the answer at step h11 is "No", the program proceeds to step h12 where the CPU 1 sets the whole analysis list as [[PB]. [NTL. NTM]. []. [NTH]] and returns the program to the main routine. If the answer at step h11 is "Yes", the program proceeds to step h10 where the CPU 1 sets the whole analysis list as [[PB]. [NTL]. []. [NTM. NTH]] and returns the program to the main routine.

In the first and second three-note part analyses, the input tones NT are allotted to each performance part in accordance with mutual intervals (tone pitch differences) of the three tones, and the performance mode is set in accordance with the allotment of the input tones. Similarly, in analysis of two tones and more than four tones, the input tones are allotted to each performance part in accordance with a musical condition.

As is understood from the above description, a performance information applied from the keyboard 4 is analyzed to detect a performance style or mode, and the input tones are grouped in accordance with the detected performance style. Thus, a chord is detected in a real time on a basis of the grouped input tones.

Since the performance information is grouped in accordance with the detected performance style, the input tones can be analyzed into a suitable part for the performance. Since the chord is detected on a basis of a key-code of the analyzed parts, it is able to extract a chord constituent tone in accordance with the performance style. This is effective to enhance accuracy of the chord detection.

What is claimed is:

1. An electronic musical apparatus capable of automatically analyzing performance information of a musical tune, said apparatus comprising:

performance information generating means for generating performance information, said performance information including performance data, tone pitch data and timing data;

storage means for storing previously generated performance information;

input means for receiving said performance information;

detection means for detecting a performance style of the performance information based on said tone pitch data and a combination of said performance data and said timing data; and analyzing means for separating the performance information into a plurality of respective performance parts in accordance with the detected performance style and said previously generated performance information.

2. An electronic musical apparatus as claimed in claim 1, further comprising chord detection means for detecting a chord on a basis of the plurality of respective performance parts.

3. An electronic musical apparatus as claimed in claim 1, further comprising:

a keyboard, operable by said performer, for generating said performance information, wherein said detection means comprises means for detecting a performance style of the performance information on a basis of plural combinations of the number of depressed keys on said keyboard, presence of a measure head at an instant timing, a strong beat or weak beat tone at the instant timing and an interval relative to said previously generated performance information.

4. An electronic musical apparatus as claimed in claim 1, wherein said detection means includes style analysis means for detecting a performance style of the performance information by analyzing a beat in a measure of the performance information, a difference in tone pitch data between previously generated tone pitch data stored in said storage means and instant tone pitch data, a number of tone pitch data from a same timing and a difference in tone pitch of the tone pitch data at the same timing.

5. An electronic musical apparatus as claimed in claim 1, wherein said performance data includes at least one of key-on data and key-off data.

6. A method for analyzing performance information in an electronic musical instrument, said method comprising the steps of:

generating performance information including performance data, tone pitch data and timing data for a musical tune;

storing previously generated performance information;

detecting a performance style of the performance information based on said tone pitch data and a combination of said performance data and said timing data; and separating the performance information into a plurality of respective performance parts in accordance with the detected performance style and said previously generated performance information.

7. A method for analyzing performance information as claimed in claim 6, further comprising the step of detecting a chord in said musical tune based on the separated plurality of respective performance parts.

8. A method for analyzing performance information as claimed in claim 6, wherein said separating step includes allotting the performance information to a melody part, a melody chord part, a bass part and a bass chord part of the musical tune in accordance with the detected performance style and said previously generated performance information.

9. A method for analyzing performance information as claimed in claim 8, further comprising the steps of:

analyzing said allotted performance information based on plural combinations of depressed keys on a keyboard, presence of a measure head at an instant timing, a strong beat or weak beat tone at the instant timing and an interval relative to previously generated performance information; and detecting a chord in said musical tune based on the allotment of the performance information and a result of the analysis of said allotted performance information.

10. A method for analyzing performance information as claimed in claim 6, wherein said detecting step comprises the step of:

detecting a performance style of the performance information on a basis of plural combinations of a number of depressed keys on a keyboard, presence of a measure head at an instant timing, a strong beat or weak beat tone at the instant timing and an interval relative to said previously generated performance information.

11. A method for analyzing performance information as claimed in claim 6, wherein said detecting step comprises the step of:

detecting a performance style of the performance information by analyzing a beat in a measure of the performance information, a difference in tone pitch data between previously generated tone pitch data stored in said storage means and instant tone pitch data, and a number of tone pitch data from a same timing and a difference in tone pitch of the tone pitch data at the same timing.

12. A method for analyzing performance information as claimed in claim 6, wherein said performance data includes at least one of key-on data and key-off data.

13. An electronic musical apparatus capable of automatically analyzing performance information of a musical tune, said apparatus comprising:

performance information generating means for generating performance information, said performance information including performance data, tone pitch data and timing data;

storage means for storing previously generated performance information;

input means for receiving said performance information;

detection means for detecting a performance style of the performance information based on said tone pitch data and a combination of said performance data and said timing data; and analyzing means for separating the performance information into a plurality of respective performance parts to be performed at the same timing in accordance with the detected performance style and said previously generated performance information.

14. A method for analyzing performance information in an electronic musical instrument, said method comprising the steps of:

generating performance information including performance data, tone pitch data and timing data for a musical tune;

storing previously generated performance information;

detecting a performance style of the performance information based on said tone pitch data and a combination of said performance data and said timing data; and separating the performance information into a plurality of respective performance parts to be performed at the same timing in accordance with the detected performance style and said previously generated performance information.

15. An electronic musical apparatus capable of automatically analyzing performance information of a musical tune, said apparatus comprising:

a processor;

a memory containing stored instructions to be performed by said processor including:

generating performance information including performance data, tone pitch data and timing data;

storing previously generated performance information;

receiving said performance information;

detecting a performance style of the performance information based on said tone pitch data and a combination of said performance data and said timing data; and separating the performance information into a plurality of respective performance parts in accordance with the detected performance style and said previously generated performance information.

* * * * *